US011374332B2

(12) United States Patent
Choi et al.

(10) Patent No.: US 11,374,332 B2
(45) Date of Patent: Jun. 28, 2022

(54) MILLIMETER WAVE BAND ARRAY ANTENNA

(71) Applicant: IUCF-HYU (INDUSTRY-UNIVERSITY COOPERATION FOUNDATION HANYANG UNIVERSITY, Seoul (KR)

(72) Inventors: Jae Hoon Choi, Seoul (KR); Sung Peel Kim, Seoul (KR)

(73) Assignee: IUCF-HYU (INDUSTRY-UNIVERSITY COOPERATION FOUNDATION HANYANG UNIVERSITY), Seoul (KR)

( * ) Notice: Subject to any disclaimer, the term of this patent is extended or adjusted under 35 U.S.C. 154(b) by 48 days.

(21) Appl. No.: 17/119,466

(22) Filed: Dec. 11, 2020

(65) Prior Publication Data

US 2021/0184369 A1 Jun. 17, 2021

(30) Foreign Application Priority Data

Dec. 16, 2019 (KR) ..... 10-2019-0168026

(51) Int. Cl.
*H01Q 21/06* (2006.01)
*H01Q 21/28* (2006.01)
(Continued)

(52) U.S. Cl.
CPC ..... *H01Q 21/062* (2013.01); *H01Q 9/065* (2013.01); *H01Q 13/10* (2013.01); *H01Q 21/28* (2013.01)

(58) Field of Classification Search
CPC .... H01Q 21/062; H01Q 21/064; H01Q 21/08; H01Q 21/28; H01Q 9/065; H01Q 13/10
See application file for complete search history.

(56) References Cited

U.S. PATENT DOCUMENTS

2014/0361946 A1 12/2014 Ganchrow et al.
2019/0273326 A1* 9/2019 Sanford ..... H04B 7/0413

FOREIGN PATENT DOCUMENTS

CN 202384500 U * 8/2012 ..... H01Q 13/22
EP 2 068 400 A1 6/2009
(Continued)

OTHER PUBLICATIONS

Hojoo Lee, et al., "A 28 GHz 5G Phased Array Antenna with Air-Hole Slots for Beam Width Enhancement", Applied Sciences, 2019, 12 pages.

(Continued)

*Primary Examiner* — Hoang V Nguyen
(74) *Attorney, Agent, or Firm* — Sughrue Mion, PLLC

(57) ABSTRACT

A millimeter wave band array antenna is disclosed. The disclosed antenna includes: a first dipole array antenna unit including first +dipole members, formed on an upper portion of a first substrate and provided with feed signals through a first feed line, and first −dipole members, formed on a lower portion of the first substrate and joined with a ground plane on a lower portion of the first substrate; and a slot antenna unit including slot radiators, which are formed on an upper portion of the first substrate, where the ground plane includes a first sloped structure having an upward slope of a first angle to the right from the point of junction with a first −dipole member and a second sloped structure having an upward slope of the first angle toward the left from the point of junction.

13 Claims, 10 Drawing Sheets
(9 of 10 Drawing Sheet(s) Filed in Color)

(51) Int. Cl.
*H01Q 9/06* (2006.01)
*H01Q 13/10* (2006.01)

(56) References Cited

FOREIGN PATENT DOCUMENTS

| | | | | | |
|---|---|---|---|---|---|
| JP | 2002135047 | A | * | 5/2002 | ..... H01Q 21/30 |
| KR | 10-2006-0016603 | A | | 2/2006 | |

OTHER PUBLICATIONS

"Array Antenna with Linear and Circular Polarization Characteristics for 28 GHz Band 5G Mobile Handset Applications", KIEES, Aug. 2019, 6 pages.

* cited by examiner

MILLIMETER WAVE BAND ARRAY ANTENNA

CROSS-REFERENCE TO RELATED APPLICATIONS

This application claims the benefit of Korean Patent Application No. 10-2019-0168026, filed with the Korean Intellectual Property Office on Dec. 16, 2019, the disclosure of which is incorporated herein by reference in its entirety.

BACKGROUND

1. Technical Field

The present invention relates to an array antenna, more particularly to a millimeter wave band array antenna.

2. Description of the Related Art

To satisfy demands for increased transmission speeds in 5G networks, the 3GPP adopted millimeter wave technology. This is because the millimeter wave band can provide a higher bandwidth than the existing 3 GHz band. However, although the millimeter wave band offers the advantage of high transmission capacity, one of its properties is that the state of the channel may vary drastically depending on the environment. A millimeter wave link may show a high transmission rate in a LOS (line-of-sight) environment, but in a NLOS (non-LOS) environment, the SINR can drop by up to 35 dB. This is because millimeter wave signals are vulnerable to obstacles such as buildings, trees, people, etc., and show very high attenuation properties.

Due to these reasons, the millimeter wave band antenna emits signals in a very narrow beam width to improve gains, resulting in an increase in the shadow area. Also, since the millimeter wave band antenna has a high frequency, there is the problem that the delay spread may be increased in a multipath propagation environment.

SUMMARY OF THE INVENTION

An aspect of the invention provides a millimeter wave band antenna capable of minimizing the occurrence of shadow areas and preventing the delay spread caused by multiple paths.

To achieve the objective above, one aspect of the invention provides a millimeter wave array antenna that includes: a first dipole array antenna unit including a multiple number of first +dipole members, which are formed on an upper portion of a first substrate and configured to be provided with feed signals through a first feed line, and a multiple number of first −dipole members, which are formed on a lower portion of the first substrate and joined with a ground plane formed on a lower portion of the first substrate; and a slot antenna unit including a multiple number of slot radiators, which are formed on an upper portion of the first substrate, a third feed line, which is formed on a lower portion of the first substrate and configured to provide feed signals to the plurality of slot radiators, and a fourth feed line, which is formed on an upper portion of a second substrate that is stacked onto an upper portion of the first substrate and which is configured to provide feed signals to the slot radiators, where the ground plane includes a first sloped structure, which has an upward slope of a first angle toward a rightward direction from a point of junction with a first −dipole member, and a second sloped structure, which has an upward slope of the first angle toward a leftward direction from the point of junction.

The first sloped structure and the second sloped structure may be formed for every point of junction between the multiple first −dipole members and the ground plane.

The array antenna may further include a second dipole array antenna unit that includes a multiple number of second +dipole members, which are formed on an upper portion of the first substrate and configured to be provided with feed signals through a second feed line, and a multiple number of second −dipole members, which are formed on a lower portion of the first substrate and joined with the ground plane formed on a lower portion of the first substrate.

The array direction of the first dipole array antenna unit and the array direction of the second dipole array antenna unit may be orthogonal to each other.

The first +dipole members, the first −dipole members, the second +dipole members, and the second −dipole members may be bent to an angle of 90 degrees or smaller.

The third feed line and the fourth feed line may provide feed signals having a phase difference of 90 degrees, so that the slot radiators may emit circularly polarized signals.

Any one of the first dipole array antenna unit, the second dipole array antenna unit, and the slot antenna unit may be selected and receive feed signals.

Another aspect of the invention provides a millimeter wave array antenna that includes: a first dipole array antenna unit including a multiple number of first +dipole members, which are formed on an upper portion of a first substrate and configured to be provided with feed signals through a first feed line, and a multiple number of first −dipole members, which are formed on a lower portion of the first substrate and joined with a ground plane formed on a lower portion of the first substrate; a second dipole array antenna unit including a multiple number of second +dipole members, which are formed on an upper portion of the first substrate and configured to be provided with feed signals through a second feed line, and a multiple number of second −dipole members, which are formed on a lower portion of the first substrate and joined with the ground plane formed on a lower portion of the first substrate; and a slot antenna unit including a multiple number of slot radiators, which are formed on an upper portion of the first substrate, a third feed line, which is formed on a lower portion of the first substrate and configured to provide feed signals to the multiple slot radiators, and a fourth feed line, which is formed on an upper portion of a second substrate that is stacked onto an upper portion of the first substrate and which is configured to provide feed signals to the multiple slot radiators, where the array direction of the first dipole array antenna unit and the array direction of the second dipole array antenna unit are different.

A millimeter wave array antenna according to certain embodiments of the invention can provides the advantages of minimizing the occurrence of shadow areas and preventing the delay spread caused by multiple paths.

Additional aspects and advantages of the present invention will be set forth in part in the description which follows, and in part will be obvious from the description, or may be learned by practice of the invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1:
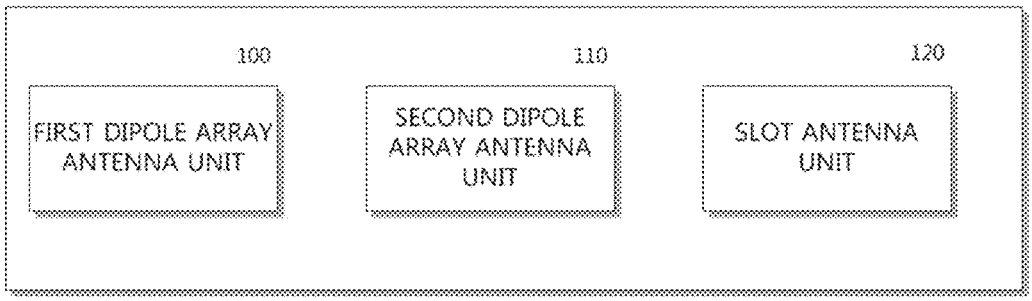
FIG. 1 is a block diagram conceptually illustrating the structure of a millimeter wave array antenna according to an embodiment of the invention.

A detailed description of the present invention is provided below, with reference to the accompanying drawings. However, the invention can be implemented in various different forms and is not limited to the embodiments described herein.

For a clearer description of the invention, the drawings may omit certain parts that are not of great relevance to the descriptions. Throughout the specification, like reference numerals are assigned to like elements.

As used throughout the specification, mention of a part being "connected" to another part not only refers to cases in which the parts are "directly connected" to each other but also encompasses cases in which the parts are "indirectly connected" with one or more other members positioned in-between.

Also, when a part is described as "comprising" or "including" an element, this description allows for the possibility of one or more other elements being further included and does not preclude the existence of other elements unless there is specific mention to the contrary.

Certain embodiments of the present invention are described below in more detail with reference to the accompanying drawings.

FIG. 1 is a block diagram conceptually illustrating the structure of a millimeter wave array antenna according to an embodiment of the invention.

Referring to FIG. 1, a millimeter wave array antenna according to an embodiment of the invention may include a first dipole array antenna unit 100, a second dipole array antenna unit 110, and a slot antenna unit 120.

The first dipole array antenna unit 100 may be structured to have multiple dipole radiators arrayed thereon. In one embodiment of the invention, a 1×8 dipole antenna array can be used, in which eight dipole radiators are arrayed in a row.

The second dipole antenna array unit 110 similarly may be structured to have multiple dipole radiators arrayed thereon, and the second dipole antenna array unit 110 similarly can, for example, have a 1×8 array structure.

The first dipole antenna array unit 100 and second dipole antenna array unit 110 can be configured to have different array directions. Preferably, the first dipole antenna array unit 100 and second antenna array unit 110 can have array directions that are orthogonal to each other. For example, if the dipole radiators of the first dipole antenna array unit 100 are arrayed along the x direction on a coordinate plane, the dipole radiators of the second dipole antenna array unit 110 may be arrayed along the y direction.

Since the first dipole antenna array unit 100 and the second dipole antenna 110 are arrayed in different directions, they will have different beam steering directions.

As the first dipole antenna array unit 100 and the second dipole antenna array unit 110 are structures having dipole radiators arrayed thereon, they are capable of emitting RF signals with linear polarization.

The slot antenna unit 120 may use multiple slots to emit RF signals. The slot antenna unit 120 may have a structure configured to emit RF signals with circular polarization.

As is known, due to the very high attenuation property of signals of the millimeter wave band, signals having directivity are exchanged, and as such, a high beam steering performance is required. In order to improve beam steering performance, an embodiment of the invention may include the first dipole antenna array unit 100 and the second dipole antenna unit 110, which may be arrayed in different directions to radiate their main beams in different directions, where one of the two dipole antenna array units may be selected to perform an exchange of RF signals according to the required beam steering property.

Also, as signals of the millimeter wave band use very high frequencies, there is the problem that delay spread may be increased when signals are transmitted over multiple paths. The slot antenna unit may be selected for use in an environment where circular polarization reception is advantageous.

Ultimately, the millimeter wave array antenna according to an embodiment of the invention may exchange RF signals through any one antenna unit in consideration of the beam direction and polarization property of the exchanged signals.

A description is provided below of the detailed structure of a millimeter wave array antenna according to an embodiment of the invention.

A millimeter wave array antenna according to an embodiment of the invention may have a structure in which two substrates (a first substrate and a second substrate) are stacked together. A description of the individual structures of the first substrate and second substrate is provided first, followed by a description of the stacked structure of the first substrate and second substrate.

Figure 2:
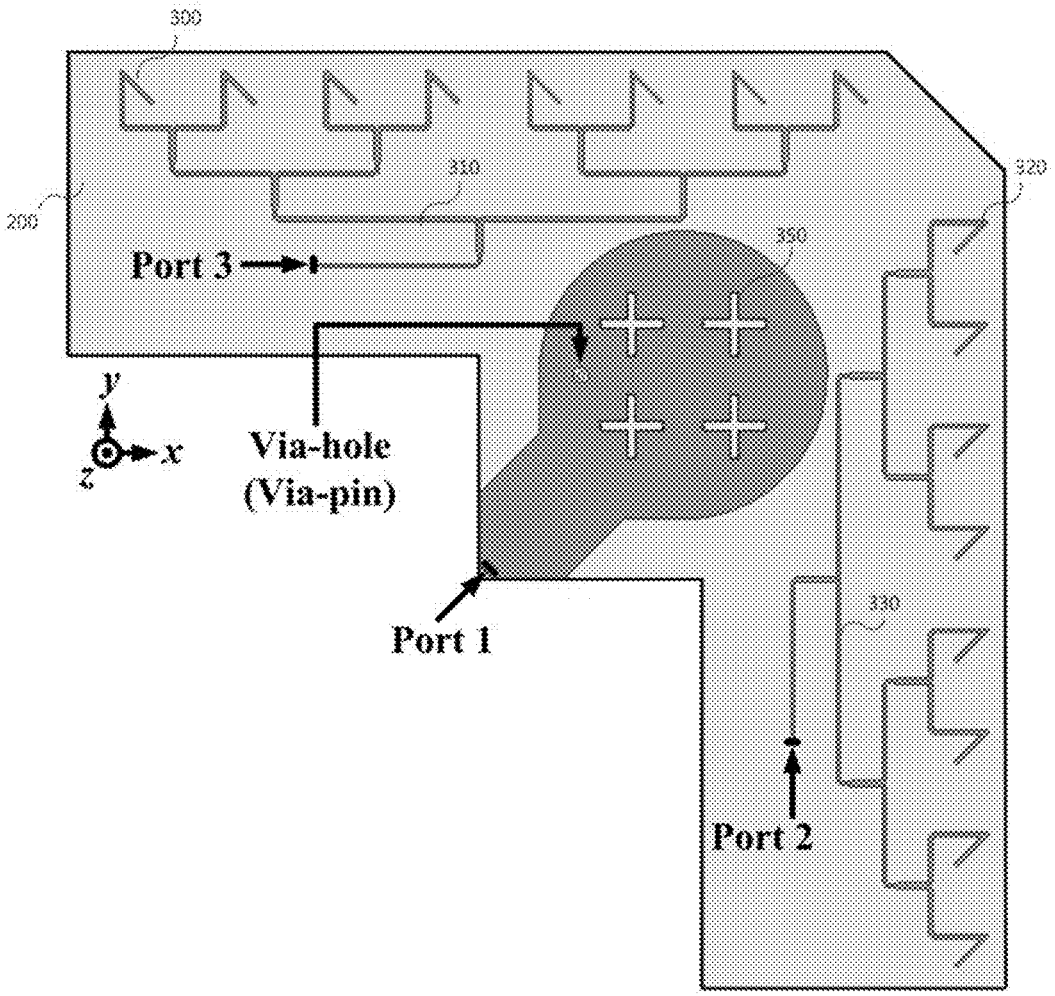
FIG. 2 is a top view of a first substrate in a millimeter wave array antenna according to an embodiment of the invention.

FIG. 2 is a top view of a first substrate in a millimeter wave array antenna according to an embodiment of the invention.

On the first substrate 200, the multiple first +dipole members 300 included in the first dipole antenna array unit 100 as well as a first feed line 310 for providing feed signals to the multiple first +dipole members 300 may be formed.

The multiple first +dipole members 300 may have an array structure, and FIG. 2 illustrates an example in which these are arrayed along the x direction.

The first feed line 310 may receive feed signals through Port 3 and may branch out multiple times to provide feed signals to the multiple first +dipole members 300. FIG. 2 illustrates an example in which the first feed line 310 branches out three times to provide feed signals to eight +dipole members.

The multiple first +dipole members 300 can be structured to extend vertically and then bend to a 45 degree at a given point. Forming the first +dipole members 300 to thus be bent to an angle of 90 degrees or smaller is so that the isolation between the multiple dipole radiators may be improved. If the environment does not have a stringent requirement as regards their isolation properties, it would be permissible to have the first +dipole members 300 bent in 90 degrees as with typical dipole members.

Also on the first substrate 200, the multiple second +dipole members 320 included in the second dipole antenna array unit 110 as well as a second feed line 330 for providing feed signals to the multiple second +dipole members 320 may be formed.

The second +dipole members 320 and second feed line 330 may be arranged with a particular distance from the first +dipole members 300 and first feed line 310.

The multiple second +dipole members 320 may also have an array structure, and FIG. 2 illustrates an example in which the second +dipole members 320 are arrayed in the y direction, perpendicular to the array direction of the first +dipole members 300.

The second feed line 330 may receive feed signals through Port 2 and may branch out multiple times to provide feed signals to the multiple second +dipole members 320. Similarly to the first feed line 310, an example is illustrated in which the second feed line 330 branches out three times to provide feed signals to eight second +dipole members.

The second +dipole members 320 and the first +dipole members 300 can have the same shape with only the array directions different.

A multiple number of slot radiators 350 may be formed on an upper portion of the first substrate 200. FIG. 2 illustrates an example in which there are four '+' shaped slot radiators 350. It should be apparent to the skilled person that the shape and number of the slot radiators 350 can be changed according to the required properties.

The multiple slot radiators 350 may be formed in an area separated from the first +dipole members 300 and second +dipole members 320. The slot radiators 350 may form a part of the slot antenna unit 120 of FIG. 1, and the feed structure for the slot radiators 350 will be described later with reference to another drawing.

Figure 3:
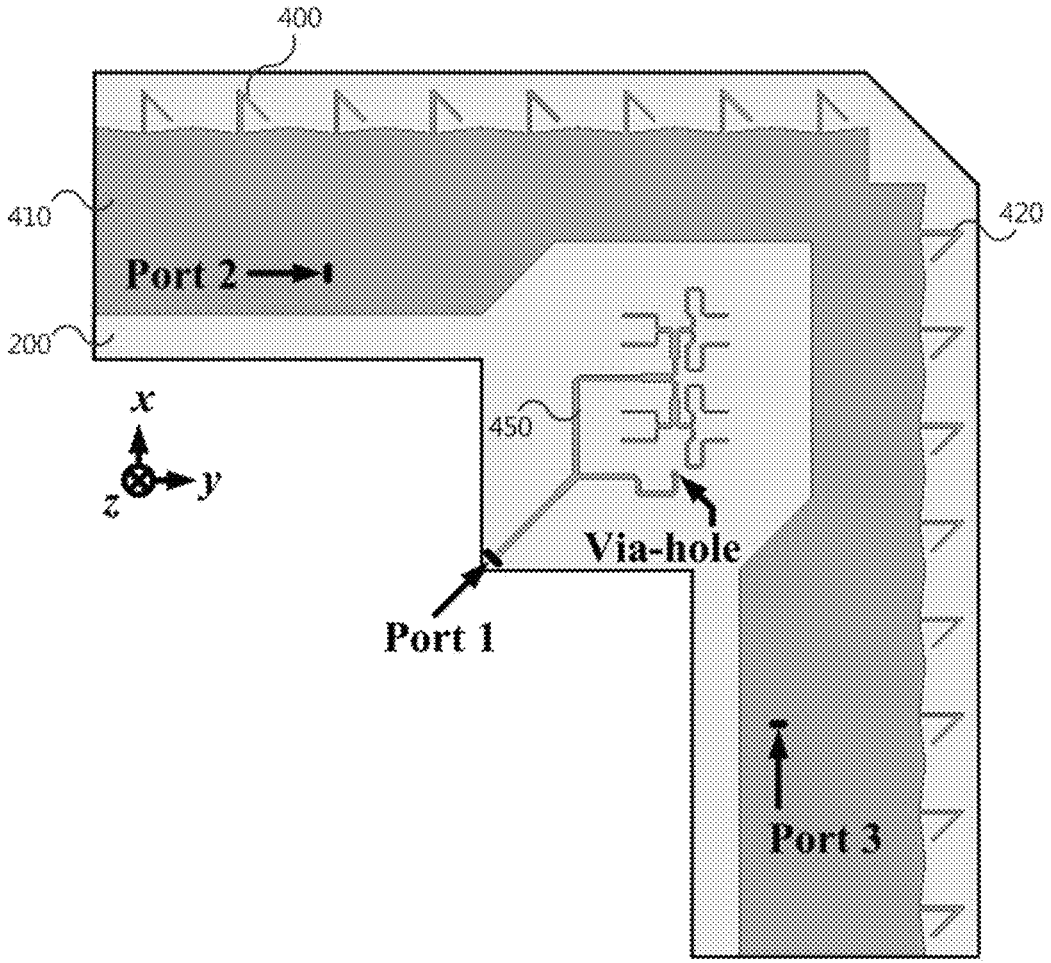
FIG. 3 is a bottom view of a first substrate in a millimeter wave array antenna according to an embodiment of the invention.

FIG. 3 is a bottom view of the first substrate in a millimeter wave array antenna according to an embodiment of the invention.

Referring to FIG. 3, on a lower portion of the first substrate 200, a multiple number of first −dipole members 400 may be formed. As is known, a dipole radiator is composed of two dipole members, a +dipole member and a −dipole member, where the +dipole member is connected with the feed line and the −dipole member is connected with the ground to emit RF signals.

In an embodiment of the invention, the first +dipole members 300 may be formed on an upper portion of the first substrate 200, and the first −dipole members 400 may be formed on a lower portion of the first substrate 200, to thereby operate as dipole radiators.

The first −dipole members 400 may also be eight in number, and a first +dipole member 300 and a first −dipole member 400 may be arranged in corresponding positions above and below to function as a dipole radiator. The first −dipole members 400 may also be arrayed along the x direction.

A ground plane 410 having a ground potential may be formed on the lower portion of the first substrate 200, and the ground plane 410 may be electrically joined with the multiple first −dipole members 400.

The first +dipole members 300 on the upper portion of the first substrate 200 and the first −dipole members 400 and ground plane 410 on the lower portion of the first substrate 200 may operate as the first dipole array antenna unit 100.

On the lower portion of the first substrate 200, a multiple number of second −dipole members 420 may be formed. The multiple second −dipole members 420 may be structured to be arrayed along the y direction in the same manner as the second +dipole members 420 and may be arrayed separated from the first −dipole members 400.

The multiple second −dipole members 420 may also be electrically connected with the ground plane 410 to be provided with a ground potential.

The multiple second −dipole members 420 may be formed in positions corresponding to those of the second +dipole members 320 on the upper portion of the first substrate 200 to thus function as dipole radiators.

The multiple second +dipole radiators 320 on the upper portion of the first substrate 200 and the multiple second −dipole radiators 420 and ground plane 410 on the lower portion of the first substrate 200 may operate as the second dipole array antenna unit 110 of FIG. 1.

On the lower portion of the first substrate 200, a third feed line 450 may be formed, in a particular area separated from the ground plane 410. The third feed line 450 may be formed in a position corresponding to the underside of the slot radiators 350 formed on the upper portion of the first substrate 200 to provide feed signals to the slot radiators 350. The third feed line 450 may be joined with Port 1 to provide the feed signals to the slot radiators 350.

Figure 4:
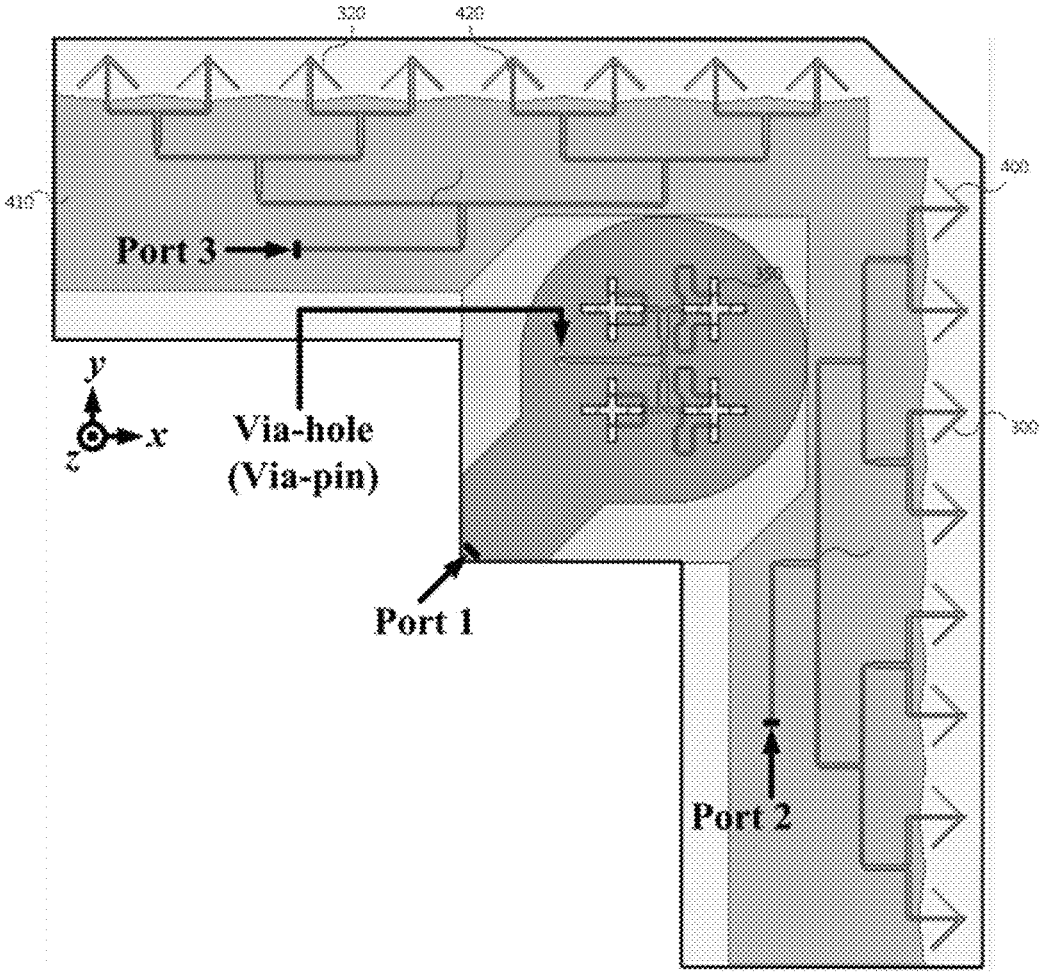
FIG. 4 is a diagram of a first substrate in a millimeter wave array antenna according to an embodiment of the invention showing both the upper and lower structures.

FIG. 4 is a diagram of the first substrate in a millimeter wave array antenna according to an embodiment of the invention showing both the upper and lower structures.

Referring to FIG. 4, it can be seen that the first +dipole members 300 and the first −dipole members 400 are formed above and below in corresponding positions. Also, the directions in which the first +dipole members 300 and the first −dipole members 400 are bent to a particular slope are opposite to each other. A similar relationship applies to the second +dipole members 320 and the second −dipole members 420.

The ground plane 410 may be positioned below the first feed line 310 and the second feed line 330, and the ground plane 410 may not only provide the ground potential to the first and second −dipole members 400, 420 but may also provide a ground potential by which feed signals may be provided through a microstrip line structure in the first feed line 310 and second feed line 330.

Figure 5:
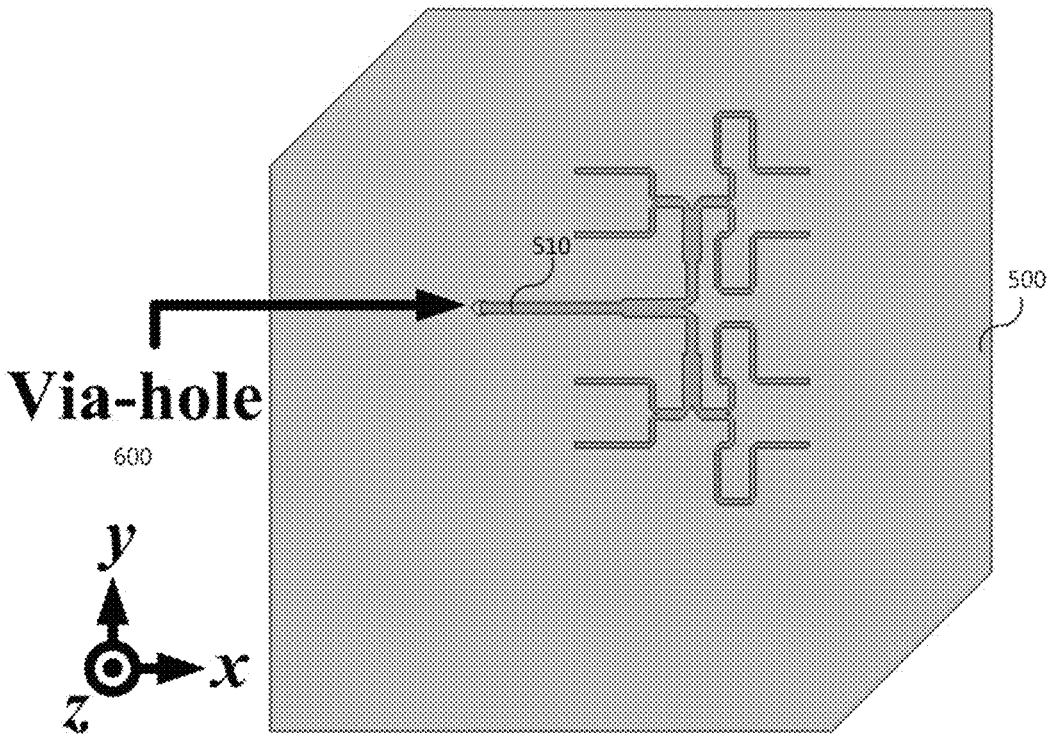
FIG. 5 is a top view of a second substrate in a millimeter wave array antenna according to an embodiment of the invention.

FIG. 5 is a top view of a second substrate in a millimeter wave array antenna according to an embodiment of the invention.

Referring to FIG. 5, a second substrate 500 according to an embodiment of the invention may have a fourth feed line 510 formed thereon. The fourth feed line 510 may provide feed signals to the slot radiators 350.

The second substrate 500 may be stacked onto the upper surface of the first substrate 200, and the fourth feed line 510 may be formed in a position corresponding to the area where the slot radiators 350 are formed on the first substrate.

The third feed line 450 described above and the fourth feed line 510 may both provide feed signals to the slot radiators, and one reason for providing feed signals via two feed lines 450, 510 in this manner is to emit circularly polarized signals from the slot radiators 350.

The feed signals provided through the third feed line 450 and the feed signals provided through the fourth feed line 510 may be fed to the slot radiators with a phase difference of 90 degrees to each other, and the third feed line 450 and fourth feed line 510 may have structures that are configured to allow feeding with a 90-degree phase difference.

To implement the phase difference of 90 degrees, a via-hole 600 may be formed in the first substrate 200 and second substrate 500. A via-pin may be inserted in the via-hole 600, and the third feed line 450 and fourth feed line 510 may be electrically connected through the via-pin. Some of the signals provided through the via-pin and through the third feed line 450 may be distributed to the fourth feed line 510, and the fourth feed line 510 may provide feed signals such that a phase difference of 90 degrees occurs with respect to the third feed line 450 by way of a phase delay. The phase delay can be achieved by suitably adjusting the length of the fourth feed line.

Figure 6:
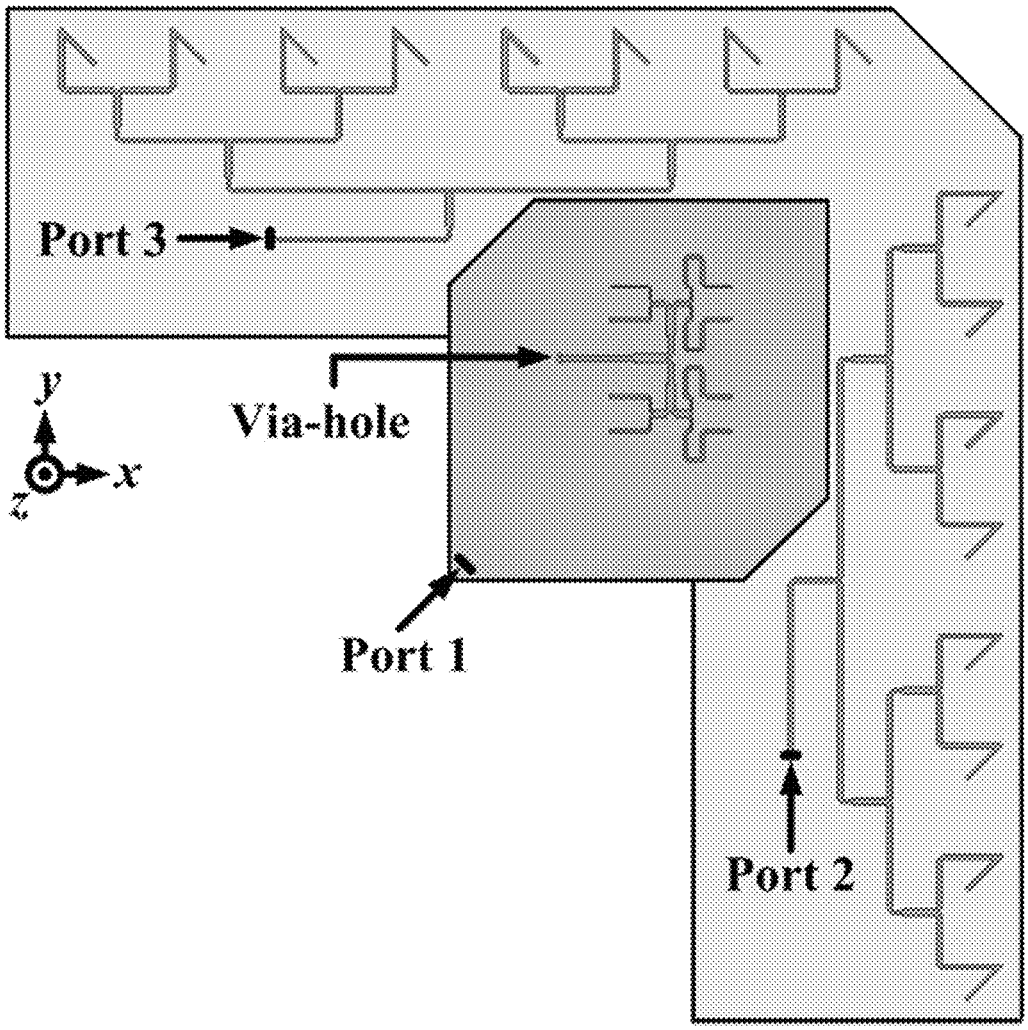
FIG. 6 is a top view of a second substrate stacked onto a first substrate in a millimeter wave array antenna according to an embodiment of the invention.
Figure 7:
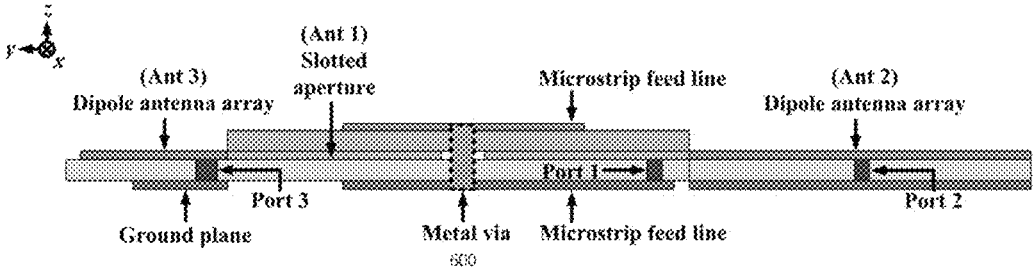
FIG. 7 is a cross-sectional view of a millimeter wave array antenna according to an embodiment of the invention.

FIG. 6 is a top view of a second substrate stacked onto a first substrate in a millimeter wave array antenna according to an embodiment of the invention, and FIG. 7 is a cross-sectional view of the millimeter wave array antenna according to an embodiment of the invention.

Referring to FIG. 6 and FIG. 7, the second substrate 500 may be stacked onto the slot radiator 350 area of the first substrate 200. Due to this structure, the slot radiators 350 may receive signal feeds through the fourth feed line 510 on the upper portion of the second substrate 500 and the third feed line 450 on the lower portion of the first substrate simultaneously.

The slot radiators 350, third feed line 450, and fourth feed line 510 may function as the slot antenna unit 120 of FIG. 1.

The structure of the via-hole 600 which penetrates through the first substrate and the second substrate can be more clearly seen through FIG. 6 and FIG. 7.

The slot antenna unit 120 of the millimeter wave array antenna described above with reference to FIGS. 1 to 7 may emit polarized signals with different rotation directions. The slot antenna unit 120 may emit LHCP (left-hand circularly polarized) signals in the +z direction with respect to the first substrate 200. Also, the slot antenna unit 120 may emit RHCP (right-hand circularly polarized) signals in the −z direction with respect to the first substrate 200.

As described above, one of the first dipole array antenna unit 100, the second dipole array antenna unit 110, and the slot antenna unit 120 may be activated to exchange signals in consideration of the required signal quality, the transmission and reception environment, the channel state, etc.

Figure 8:
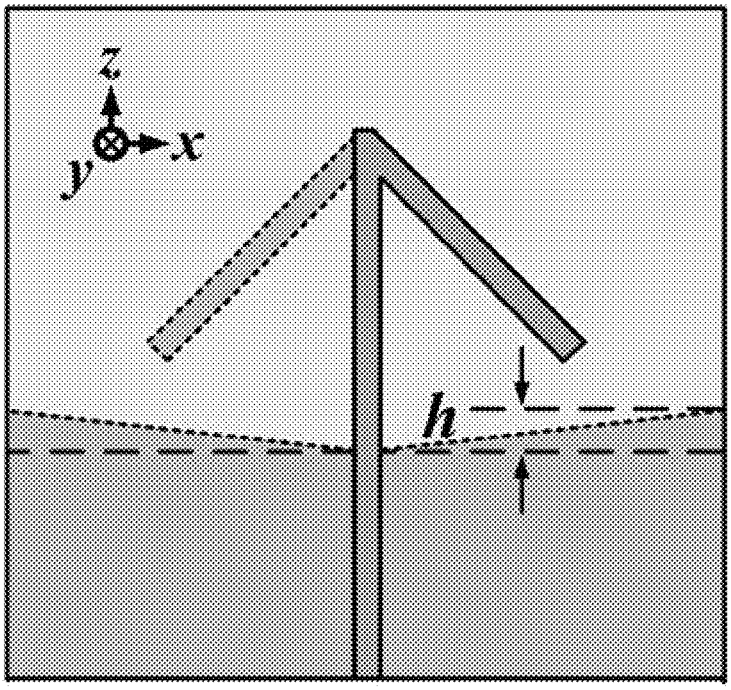
FIG. 8 is a diagram illustrating the structure of a ground plane formed on the lower surface of a first substrate in a millimeter wave array antenna according to an embodiment of the invention.

FIG. 8 is a diagram illustrating the structure of a ground plane formed on the lower surface of a first substrate in a millimeter wave array antenna according to an embodiment of the invention.

The ground plane of a millimeter wave array antenna according to an embodiment of the invention may be joined with the first and second −dipole members 400, 420, being joined with the vertically extending portions of the −dipole members 400, 420.

While a typical ground plane is formed in a direction perpendicular to the vertically extending portions (i.e. a horizontal direction), a ground plane according to an embodiment of the invention may have sloped structures with respect to the points of junction with the −dipole members.

More specifically, the ground plane may include a first sloped structure, which may have an upward slope of a first angle toward the right from the point of junction with a −dipole member, and a second sloped structure, which may have an upward slope of the first angle toward the left from the point of junction.

Referring to FIG. 8, due to such a sloped structure, the height of the junction part at which the vertically extending portion of the −dipole member is joined and the height of the distal end portion of the sloped structure are made different, resulting in a height difference h as shown in FIG. 8. The height difference h can be adjusted by the angle of the slope.

The structure of the ground plane, such as that illustrated in FIG. 8, is one of the main features of the present invention. The impedance matching properties of an array antenna can be improved with a ground plane structure based on an embodiment of the invention, especially when the dipole members have structures bent to an angle of 90 degrees or smaller (for example, 45 degrees) as illustrated in FIG. 8.

As described above, forming the dipole members in structures that are bent to angles of 90 degrees or smaller is in order to obtain isolation properties. However, such a structure that is bent to 90 degrees or smaller faces the problem of degraded impedance matching properties.

In an embodiment of the invention, a first sloped structure and a second sloped structure that are symmetrical about the point of junction where a −dipole member is joined to the ground plane may be formed to prevent such degradation in impedance matching properties.

Figure 9:
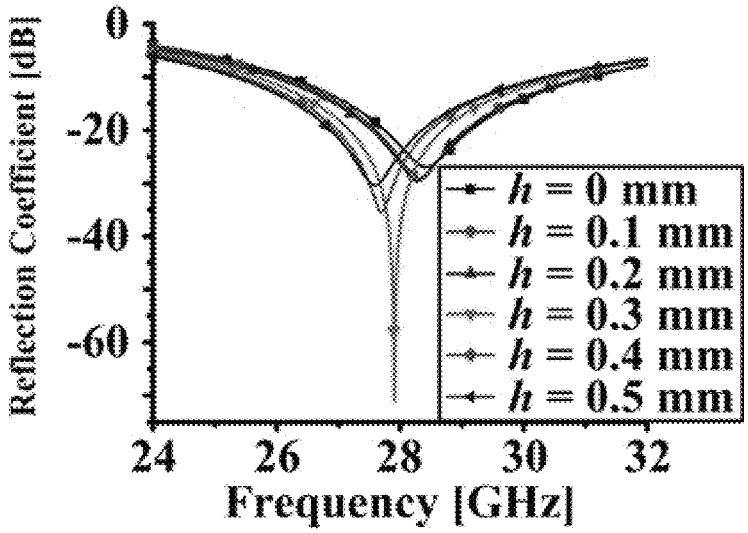
FIG. 9 is a graph showing changes in the reflection coefficient according to changes in h in an embodiment of the invention.

FIG. 9 is a graph showing changes in the reflection coefficient according to changes in h in to an embodiment of the invention.

FIG. 9 shows that the reflection coefficient changes according to changes in h, from which it can be understood that the impedance matching properties can be improved by finding a suitable h value.

Figure 10:
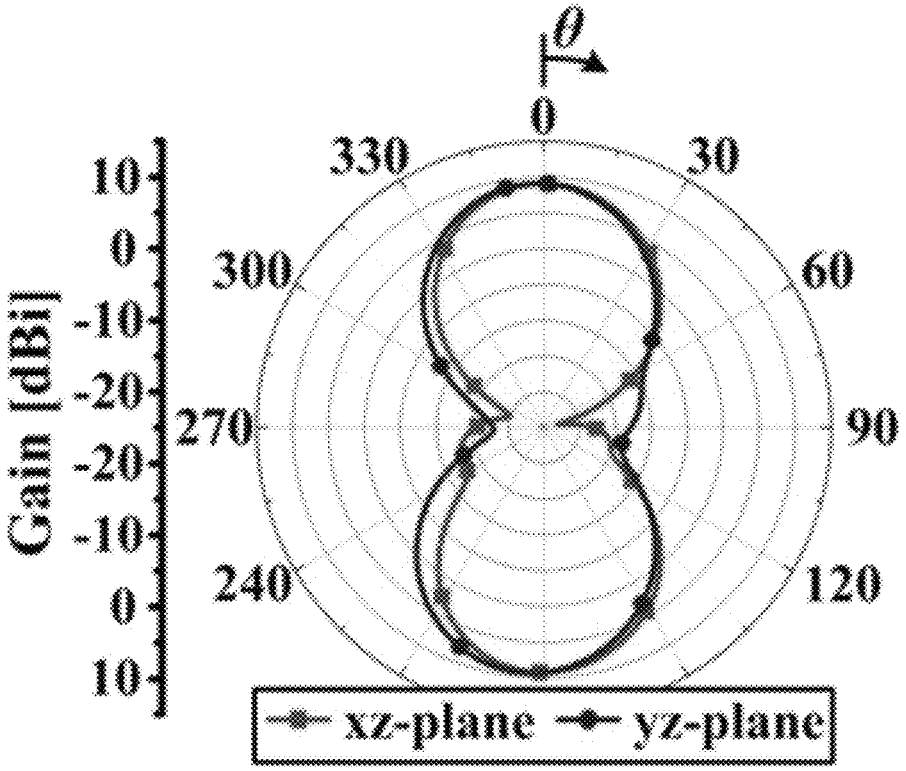
FIG. 10 is 3-dimensional and 2-dimensional representations of the radiation pattern of a slot antenna unit according to an embodiment of the invention.

FIG. 10 is 2-dimensional representations of the radiation pattern of a slot antenna unit according to an embodiment of the invention.

Referring to FIG. 10, it can be seen that the radiation pattern of the slot antenna unit forms a LHCP circular polarization in the +z region and forms a RFCP circular polarization in the −z region.

The descriptions set forth above are for illustrative purposes only, and it is to be appreciated that the person having ordinary skill in the field of art to which the present invention pertains can readily provide modifications into different specific forms without altering the technical spirit or essential features of the present invention.

Therefore, it should be understood that the embodiments described above are illustrative in all aspects and do not limit the invention.

For example, an element described in the singular can be practiced in a distributed form, and likewise, elements described in a distributed form can be practiced in an integrated form.

The scope of the present invention are defined by the scope of claims below, and it is to be appreciated that all modifications or variations derived from the interpretation and scope of the claims and their equivalent concepts are encompassed within the scope of the present invention.

What is claimed is:

1. A millimeter wave array antenna comprising:

a first dipole array antenna unit comprising a plurality of first +dipole members and a plurality of first −dipole members, the plurality of first +dipole members formed on an upper portion of a first substrate and configured to be provided with feed signals through a first feed line, the plurality of first −dipole members formed on a lower portion of the first substrate and joined with a ground plane formed on a lower portion of the first substrate; and a slot antenna unit comprising a plurality of slot radiators, a third feed line, and a fourth feed line, the plurality of slot radiators formed on an upper portion of the first substrate, the third feed line formed on a lower portion of the first substrate and configured to provide feed signals to the plurality of slot radiators, the fourth feed line formed on an upper portion of a second substrate stacked onto an upper portion of the first substrate, the fourth feed line configured to provide feed signals to the plurality of slot radiators, wherein the ground plane has a first sloped structure and a second sloped structure formed therein, the first sloped structure having an upward slope of a first angle toward a rightward direction from a point of junction with a first −dipole member, the second sloped structure having an upward slope of the first angle toward a leftward direction from the point of junction.

2. The millimeter wave array antenna of claim 1, wherein the first sloped structure and the second sloped structure are formed for every point of junction between the plurality of first −dipole members and the ground plane.

3. The millimeter wave array antenna of claim 1, further comprising:

a second dipole array antenna unit comprising a plurality of second +dipole members and a plurality of second −dipole members, the plurality of second +dipole members formed on an upper portion of the first substrate and configured to be provided with feed signals through a second feed line, the plurality of second −dipole members formed on a lower portion of the first substrate and joined with the ground plane formed on a lower portion of the first substrate.

4. The millimeter wave array antenna of claim 3, wherein an array direction of the first dipole array antenna unit and an array direction of the second dipole array antenna unit are orthogonal to each other.

5. The millimeter wave array antenna of claim 4, wherein the first +dipole members, the first −dipole members, the second +dipole members, and the second −dipole members are bent to an angle of 90 degrees or smaller.

6. The millimeter wave array antenna of claim 3, wherein any one of the first dipole array antenna unit, the second dipole array antenna unit, and the slot antenna unit is selected for receiving feed signals.

7. The millimeter wave array antenna of claim 1, wherein the third feed line and the fourth feed line provide feed signals having a phase difference of 90 degrees such that the slot radiators emit circularly polarized signals.

8. A millimeter wave array antenna comprising:

a first dipole array antenna unit comprising a plurality of first +dipole members and a plurality of first −dipole members, the plurality of first +dipole members formed on an upper portion of a first substrate and configured to be provided with feed signals through a first feed line, the plurality of first −dipole members formed on a lower portion of the first substrate and joined with a ground plane formed on a lower portion of the first substrate;

a second dipole array antenna unit comprising a plurality of second +dipole members and a plurality of second −dipole members, the plurality of second +dipole members formed on an upper portion of the first substrate and configured to be provided with feed signals through a second feed line, the plurality of second −dipole members formed on a lower portion of the first substrate and joined with the ground plane formed on a lower portion of the first substrate; and a slot antenna unit comprising a plurality of slot radiators, a third feed line, and a fourth feed line, the plurality of slot radiators formed on an upper portion of the first substrate, the third feed line formed on a lower portion of the first substrate and configured to provide feed signals to the plurality of slot radiators, the fourth feed line formed on an upper portion of a second substrate stacked onto an upper portion of the first substrate, the fourth feed line configured to provide feed signals to the plurality of slot radiators, wherein an array direction of the first dipole array antenna unit and an array direction of the second dipole array antenna unit are different.

9. The millimeter wave array antenna of claim 8, wherein the array direction of the first dipole array antenna unit and the array direction of the second dipole array antenna unit are orthogonal to each other.

10. The millimeter wave array antenna of claim 9, wherein the ground plane has a first sloped structure and a second sloped structure formed therein, the first sloped structure having an upward slope of a first angle toward a rightward direction from a point of junction with a first −dipole member, the second sloped structure having an upward slope of the first angle toward a leftward direction from the point of junction.

11. The millimeter wave array antenna of claim 10, wherein the first sloped structure and the second sloped structure are formed for every point of junction between the plurality of first −dipole members and the ground plane.

12. The millimeter wave array antenna of claim 8, wherein the first +dipole members, the first −dipole members, the second +dipole members, and the second −dipole members are bent to an angle of 90 degrees or smaller.

13. The millimeter wave array antenna of claim 8, wherein the third feed line and the fourth feed line provide feed signals having a phase difference of 90 degrees such that the slot radiators emit circularly polarized signals.

* * * * *